US007784175B2

(12) United States Patent
Yagi et al.

(10) Patent No.: US 7,784,175 B2
(45) Date of Patent: Aug. 31, 2010

(54) TERMINAL CRIMPING APPARATUS

(75) Inventors: Satoshi Yagi, Makinohara (JP); Shigeharu Suzuki, Makinohara (JP); Naoki Kakuta, Makinohara (JP); Tetsuro Ide, Makinohara (JP); Hideto Kumakura, Makinohara (JP); Kenji Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 254 days.

(21) Appl. No.: 11/970,081

(22) Filed: Jan. 7, 2008

(65) Prior Publication Data

US 2008/0172865 A1 Jul. 24, 2008

(30) Foreign Application Priority Data

Jan. 18, 2007 (JP) ..... 2007-009135

(51) Int. Cl.
*H01R 43/042* (2006.01)

(52) U.S. Cl. ..... 29/753; 29/751; 29/761; 29/861; 29/863; 72/352; 72/353.6; 72/370.12; 72/470; 76/4; 76/30; 76/107.1; 439/877

(58) Field of Classification Search ..... 29/751, 29/753, 761, 861, 863; 72/352, 370.12, 470
See application file for complete search history.

(56) References Cited

U.S. PATENT DOCUMENTS 2,818,632 A * 1/1958 Hammell ..... 29/865
5,414,926 A * 5/1995 Ito et al. ..... 29/753

FOREIGN PATENT DOCUMENTS

JP 2002-373755 A 12/2002
JP 2006-49117 A 2/2006

* cited by examiner

*Primary Examiner*—Derris H Banks
*Assistant Examiner*—Azm Parvez
(74) *Attorney, Agent, or Firm*—Sughrue Mion, PLLC

(57) ABSTRACT

A terminal crimping apparatus includes an anvil for supporting a metal terminal including a base plate portion for placing an electric wire thereon and a pair of crimping piece portions extending upwardly respectively from opposite side edges of the base plate portion and a crimper which includes a press-deforming portion having a generally arch-shape formed of two arc-shaped surfaces which are opposed to the anvil. The anvil and the crimper cooperate to press the crimping piece portions for crimping the crimping piece portions to the electric wire placed on the metal terminal. The shape of the crimper satisfies a formula, Index a=c·cos θ, where c represents a length of the arc-shaped surface of the crimper, and θ represents an angle formed by a tangential line to the arc-shaped surface at a central portion of the crimper and a vertical line.

1 Claim, 7 Drawing Sheets

40
41
50
52

TERMINAL CRIMPING APPARATUS

BACKGROUND

This invention relates to a terminal crimping apparatus for crimping a metal terminal (having a pair of crimping piece portions (barrel) extending upwardly respectively from opposite side edges of a base plate portion thereof) to a core wire of an electric wire.

There is known one conventional terminal crimping apparatus for crimping a terminal to a core wire of an electric wire, in which crimping piece portions of the terminal are pressed by an anvil and a crimper, and are press-fastened to the core wire (see, for example, JP-A-2002-373755 (FIG. 1)).

As shown in FIG. 7, the apparatus disclosed in JP-A-2002-373755 includes the anvil 4 for holding the metal terminal 6, and the crimper 3 located above the anvil 4 and having a pair of press-deforming portions 2 and 2 formed on a surface thereof facing the anvil 4. In this apparatus, a core wire 7 is placed on and received in the metal terminal 6 supported on the anvil 4, and in this condition the crimper 3 is moved downward, so that crimping piece portions 6*a* and 6*a* (jointly assuming a generally U-shaped cross-section) are pressed between the crimper 3 and the anvil 4, and are press-fastened to the core wire 7.

In recent years, with a compact design of electronic equipments, there have been proposed metal terminals for connection to a very thin electric wire including a core wire having a cross-sectional area of 0.08 to 0.13 $mm^2$. In such very thin electric wires, a copper alloy harder than conventionally-used annealed copper and brass is used as a material for the core wire in view of a wire strength. However, the conventional crimping apparatus is not designed for such a thin, hard electric wire, and therefore when the metal terminal is crimped to the very thin electric wire with this conventional crimping apparatus, there is a fear that there may develop variations in the amount of biting of the crimping piece portions of the metal terminal and the height and width of a wire crimped portion of the metal terminal. And besides, when such variations develop, the crimped shape becomes unstable, which leads to a fear that a clamping force and an electrical performance may be lowered. Furthermore, in the case of the very thin electric wire, the connection performance is particularly adversely affected by the above variations.

Therefore, there has been proposed a terminal crimping method designed for a very thin electric wire (see, for example, JP-A-2006-49117 (FIGS. 3 and 4)). In the method disclosed in JP-A-2006-49117, dimensions of a metal terminal and dimensions (a height and a width of a crimped portion) of the crimped metal terminal are decreased according to the down-sizing of the electric wire, and the crimped terminal is produced, and by doing so, the optimum range is determined. And, in the case of a very thin electric wire including a high-strength core wire, the metal terminal is press-fastened without contact with the core wire, and by doing so, a sufficient tensile strength is secured even when the terminal is crimped to the core wire.

However, in the above conventional crimping technique for the very thin electric wire, when variations develop in the amount of biting of crimping piece portions of the metal terminal and the height (crimp height) and width (crimp width) of the crimped portion, the crimped shape becomes unstable, which leads to a fear that the clamping force and the electrical performance may be lowered.

When the metal terminal is crimped to the very thin electric wire, there develop the reduced contact area due to the increased crimp height caused by the overlapping of one crimping piece portion of the metal terminal on the other crimping piece portion, the reduced strength of the conductor due to the reduced crimp height caused by the bottoming of one crimping piece portion, etc. Therefore, there has been encountered a problem that the force (strength) of clamping of the metal terminal to the electric wire is lowered, so that the mechanical and electrical performances are lowered.

SUMMARY

Therefore, it is an object of this invention to provide a terminal crimping apparatus in which when a terminal is crimped to a very thin electric wire, there is obtained a wire crimped portion which is made stable in shape, and is excellent in mechanical and electrical performances.

The above object of the present invention has been achieved by the following construction.

(1) A terminal crimping apparatus comprising:

an anvil for supporting a metal terminal including a base plate portion for placing an electric wire thereon and a pair of crimping piece portions extending upwardly respectively from opposite side edges of the base plate portion; and a crimper which includes a press-deforming portion having a generally arch-shape formed of two arc-shaped surfaces which are opposed to the anvil, wherein the anvil and the crimper cooperate to press the crimping piece portions for crimping the crimping piece portions to the electric wire placed on the metal terminal; and wherein the shape of the crimper satisfies a formula, Index $a=c\cdot\cos\theta$, where c represents a length of the arc-shaped surface of the crimper, and θ represents an angle formed by a tangential line to the arc-shaped surface at a central portion of the crimper and a vertical line.

In the terminal crimping apparatus of the above Paragraph (1), the shape of the crimper is designed using the formula, Index $a=c\cdot\cos\theta$, where c represents the length of the arc-shaped surface of the crimper, and θ represents the angle formed by the tangential line to the arc-shaped surface at the central portion of the crimper and the vertical line. Therefore, the crimping piece portion of the metal terminal properly bite into the electric wire, so that the shape of a wire crimped portion is stable. Therefore, in the condition in which the metal terminal is crimped to a conductor of the electric wire, the area of contact between the metal terminal and the conductor as well as a contact load is stable.

Here, preferably, Index $a=c\cdot\cos\theta$ is in the range of from 0.7 to 0.85 ($0.7\leqq a\leqq 0.85$).

If Index a is less than 0.7 ($a\leqq 0.7$), the amount of biting of each crimping piece portion of the metal terminal into the wire is insufficient, and the area of contact between the metal terminal and the conductor of the electric wire is reduced, and the contacting reliability is lowered.

On the other hand, if Index a is more than 0.85 ($a>0.85$), the amount of biting of each crimping piece portion of the metal terminal into the electric wire is excessive, so that the conductor of the electric wire is much damaged, and the force (strength) of clamping of the metal terminal to the electric wire is lowered. And besides, it is difficult to process the crimper.

The terminal crimping apparatus of the above Paragraph (1) is particularly effective in the case where the metal terminal is crimped to a core wire (conductor having a cross-sectional area of 0.08 to 0.13 $mm^2$, and in this case the shape of the wire crimped portion is made stable.

The terminal crimping apparatus of the above Paragraph (1) is particularly effective in the case where the metal terminal is crimped to the core wire made of a copper alloy harder than conventionally-used annealed copper and brass, and in this case the shape of the wire crimped portion is made stable.

The invention is effective in the case where the metal terminal is crimped to the core wire made, for example, of a copper alloy or the like containing tin (Sn).

In the present invention, the wire crimped portion can be formed into the predetermined height and width, and the shape of the wire crimped portion is made stable, and therefore there can be obtained the wire crimped portion which is not lowered in mechanical and electrical characteristics, and therefore is excellent in these characteristics.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the present invention will now be described with reference to the accompanying drawings.

Figure 1:
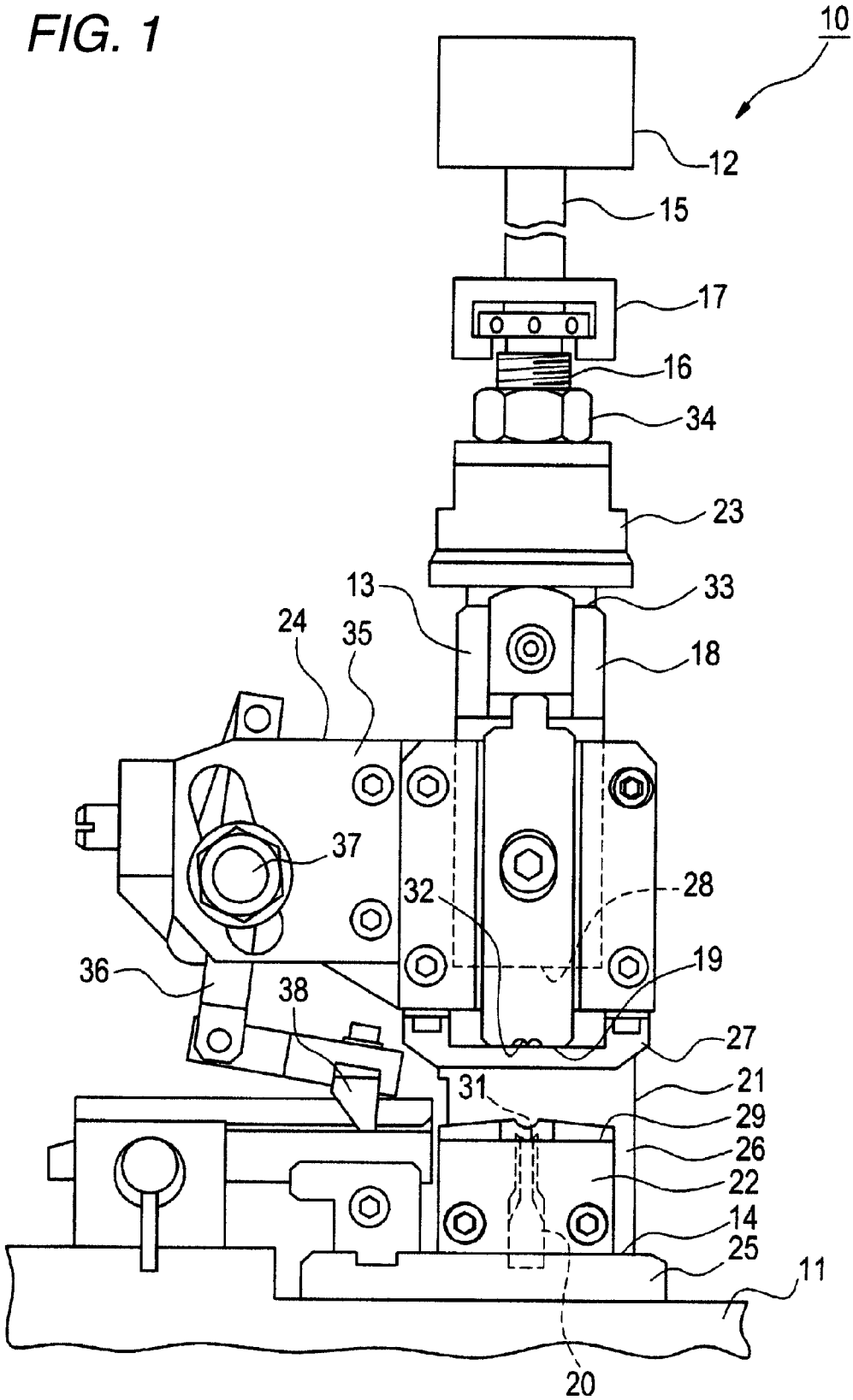
FIG. 1 is a front-elevational view of one preferred embodiment of a terminal crimping apparatus of the present invention.
Figure 2:
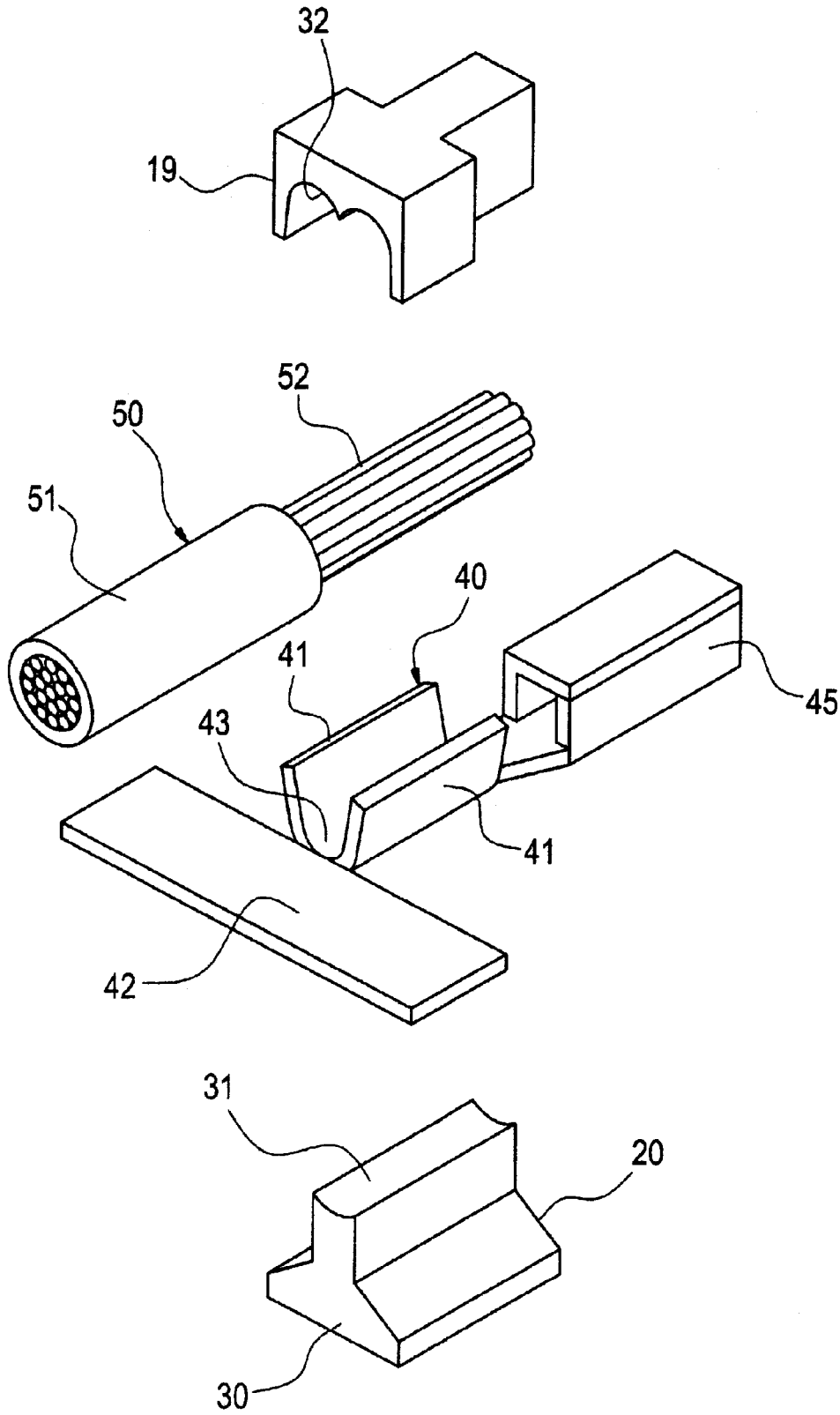
FIG. 2 is an exploded, perspective view showing a crimper, an anvil and an electric wire used in the crimping apparatus of FIG. 1.
Figure 3:
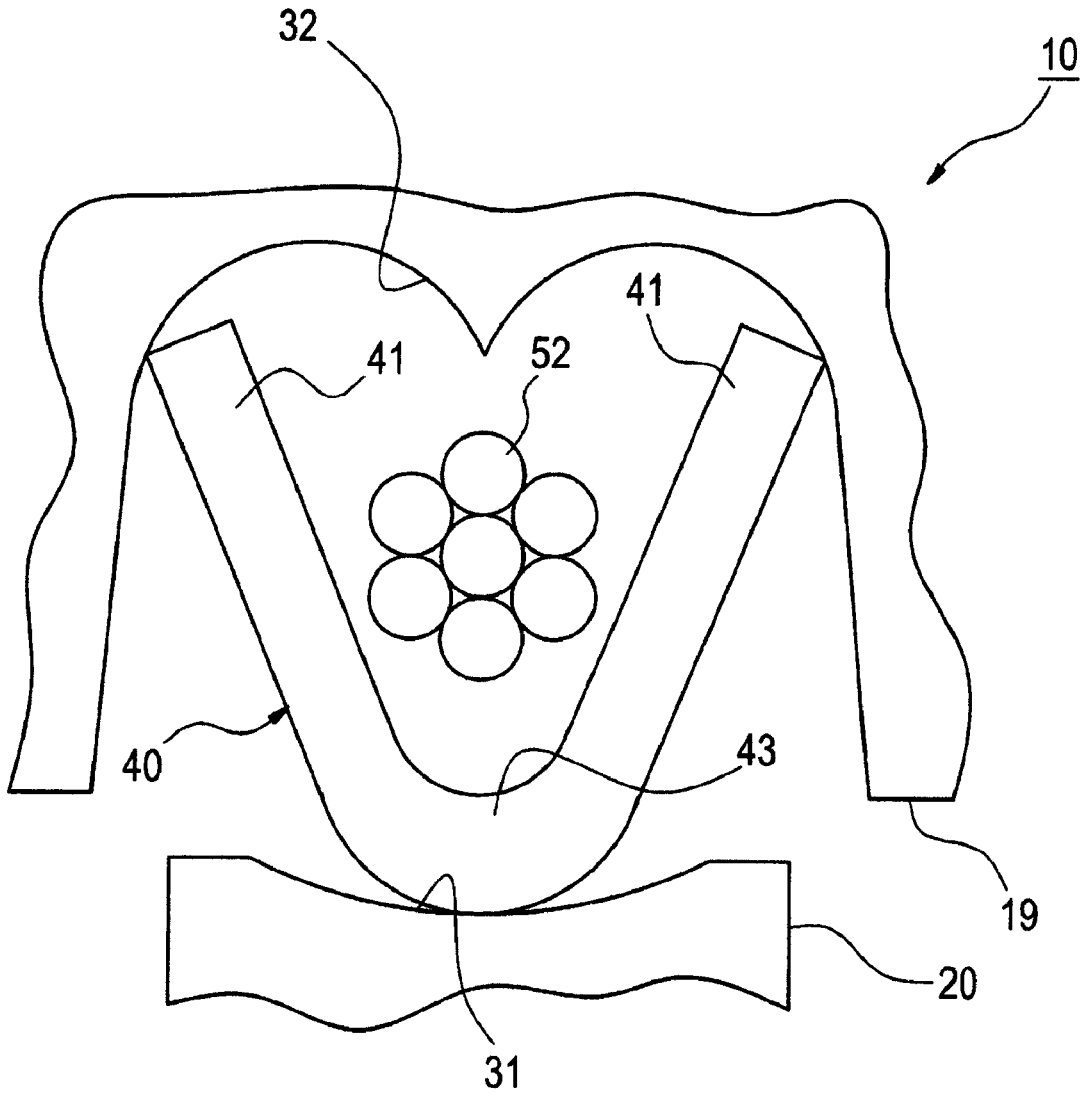
FIG. 3 is an enlarged view of an important portion of the terminal crimping apparatus of FIG. 1.

FIG. 1 is a front-elevational view of one preferred embodiment of a terminal crimping apparatus of the invention, FIG. 2 is a perspective view showing a crimper and an anvil used in the crimping apparatus of FIG. 1, and FIG. 3 is an enlarged view of an important portion of the crimping apparatus of FIG. 1.

As shown in FIGS. 1 and 2, the crimping apparatus 10 of the invention includes a base 11 placed on a floor or the like, a drive source 12, and a crimping applicator 13 for crimpingly connecting the metal terminal 40 to an electric wire 50.

The base 11 has a flat portion 14 which is generally flat in a horizontal direction. The crimping applicator 13 is placed and supported on the base 11.

The drive source 12 includes a servomotor (not shown), a drive shaft 15 for transmitting a driving force, and a hook 17 engaged with a disk portion (not shown) of a shank 16. A rotational motion of the servomotor is converted into a linear motion via a piston-crank mechanism so as to move a ram 18 upward and downward. Instead of the servomotor, a hydraulic cylinder having a piston rod connected to the shank 16 in directly-driving relation or other suitable drive means may be used.

The crimping applicator 13 includes the crimper (terminal crimping die) 19, and the anvil 20. The crimper 19 is moved downward to press-deform crimping piece portions 41 of the metal terminal 40, thereby crimping the crimping piece portions 51 to the electric wire 50.

Various forms of metal terminals can be used as the metal terminal 40 which is to be press-deformed by the crimping applicator 13. For example, a female metal terminal having a box-like electrical contact portion, a male terminal having a tab-like electrical contact portion, a joint metal terminal for connecting two wires together, etc., can be used.

The metal terminal 40 is formed by blanking a piece of a predetermined shape from an electrically-conductive sheet and then by bending this piece into a required shape. The metal terminal 40 includes a sheath clamping (crimping) piece portion 42 adapted to be press-clamped to a sheath 51 of the electric wire 50, a curved base plate portion 43 on which that portion of a core wire (conductor) 52 of the electric wire 50 from which the sheath 51 has been removed is adapted to be placed, the pair of crimping piece portions 41 extending upwardly respectively from opposite side edges of the base plate portion 43, and a electrical contact portion 45 of a square tubular shape.

The pair of crimping piece portions 41 of the metal terminal 40 are press-deformed or bent inwardly by the downward movement of the crimper 19, and therefore are crimped to the core wire 52 of the electric wire 50 to be electrically connected thereto.

A rotational motion of the servomotor is converted into a linear motion by the piston/crank mechanism so as to move the ram 18 (holding the crimper 19) upward and downward, thereby moving the crimper 19 upward and downward. There is provided a control portion (not shown) for controlling the upward and downward movement of the ram 18, and this control portion effects various controls including the acceleration, deceleration, crimping movement and standing-by of the ram 18.

The crimping applicator 13 includes a frame 21, a holder 22 having the anvil 20, the ram 18 supported on the frame 21, a ram bolt 23 threadedly engaged with the ram 18 so as to enable the upward and downward movement of the ram 18, the shank 16 threadedly engaged with the ram bolt 23, and a terminal feed unit 24.

The frame 21, when viewed from the side thereof, has a generally recumbent U-shape, and includes a mounting portion 25 on which the holder 22 is mounted, an upwardly-extending support post portion 26, and a ram support portion 27.

The frame 21 is placed on the flat portion 14 of the base 11, and is fixed thereto to bolts and nuts (not shown). The frame 21 may be integrally fixed to the base 11.

The ram support portion 27 is connected to an upper end portion of the support post portion 26 extending upwardly from the mounting portion 25 on which the holder 22 is mounted. A space for guiding the ram 18 is formed in the ram support portion 27, and the ram 18 is slidably fitted in this space.

The anvil 20 for the placing of the metal terminal 40 thereon is embedded in the holder 22. The holder 22 has a flat surface 29 opposed to both of the crimper 19 and a lower end surface 28 of the ram 18. Namely, the flat surface 29 is disposed substantially perpendicularly to both of the direction of movement of the ram 18 and a direction of movement of the crimper 19.

The anvil 20 is received and held in the holder 22, and in this condition the holder 22 is mounted on the mounting portion 25 of the frame 21. The anvil 20 is held in the holder 22, with its bottom plate 30 disposed in intimate contact with a bottom wall of the holder 22, and therefore the anvil 20 can support the metal terminal 40 thereon without being shaken.

The anvil 20 abuts against the base plate portion 43 of the metal terminal 40, and upon application of a pressing force from the crimper 19, the anvil 20 cooperates with the crimper 19 to press-deform the crimping piece portions 41 into a predetermined shape.

The anvil 20 has a contact surface for contact with the base plate portion 43 of the metal terminal 40, and a curved surface 31 is formed on this contact surface.

The ram 18 has a generally rectangular parallelepiped shape. The ram 18 is supported in the ram support portion 27 so as to move upward and downward in the vertical direction.

A longitudinal axis of the ram 18 extends in the direction of movement thereof, that is, in the vertical direction. The lower end surface 28 of the ram 18 is flat, and is perpendicular to the direction of movement of the ram 18.

The crimper 19 is provided at a lower half portion of the ram 18 in opposed relation to the anvil 20. The ram 18 is supported in the ram support portion 27 so as to move upward and downward, and therefore the crimper 19 can be moved toward and away from the anvil 20. In other words, the crimper 19 is moved toward and away from the anvil 20 in accordance with the downward and upward movement of the ram 18.

The crimper 19 is in the form of a generally rectangular parallelepiped-shaped plate, and a press-deforming portion 32 of a generally arch-shape is formed at an inner surface of the crimper 19 opposed to the anvil 20. The press-deforming portion 32 is formed into a curved shape or generally arcuate shape so as to press-deform the crimping piece portions 41 of the metal terminal 40 into a predetermined shape.

The ram bolt 23 is threaded into a threaded hole formed in an upper end surface 33 of the ram 18, and therefore is mounted on the ram 18. By thus mounting the ram bolt 23 on the ram 18, the ram 18 can be moved upward and downward.

The shank 16 has a hollow cylindrical shape. The disk portion formed at one end of the shank 16 is connected to the hook 17 of the drive source 12, and a screw portion formed at the other end of the shank 16 is threaded in a screw hole in the ram bolt 23. Namely, the shank 16 transmits a driving force of the drive source 12 to the ram 18 via the ram bolt 23 so as to move the crimper 19 upward and downward.

The amount of threading of the shank 16 in the screw hole of the ram bolt 23 can be adjusted, and therefore the shank 16 is mounted on the ram bolt 23 in such a manner that the position of the shank 16 relative to the ram bolt 23 can be changed. When the position of the shank 16 relative to the ram bolt 23 is changed by adjusting the amount of threading of the shank 16 in the screw hole of the ram bolt 23, the distance (gap) between the anvil 20 and the crimper 19 is also changed.

The shank 16 has a nut 34 threaded on an externally-threaded portion thereof, and the nut 34 is tightened, with the shank 16 threaded in the screw hole of the ram bolt 23, and by doing so, the ram bolt 23 and the shank 16 can be fixed to each other.

The terminal feed unit 24 includes a cam (not shown) provided at a side portion of the ram 18, a connecting rod (not shown) adapted to abut against the cam to be moved in the horizontal direction, a lever support portion 35 receiving the connecting rod therein, a crank-like lever 36 fitted in the lever support portion 35, a pivot shaft 37 supporting the lever 36 in a manner to allow a pivotal movement of the lever 36, and a terminal feed claw 38 provided at a distal end portion of the lever 36.

In the terminal feed unit 24, the cam is moved downward by the driving force of the drive source 12, and at this time the connecting rod abuts at its one end against the cam, and is pushed to be moved in the horizontal direction, so that the other end portion of the connecting rod is brought into abutting engagement with the lever 36, and the lever 36 is pivotally moved about the pivot shaft 37. As a result, the terminal feed claw 38 is engaged in a feed hole in a chain-like band having a series of metal terminals 40, and feeds this chain-like band in a terminal feeding direction to feed one metal terminal at a time to a crimping position.

As shown in FIG. 3, the base plate portion 43 of the metal terminal 40 is placed on the curved surface 31 of the anvil 20, and the core wire 52 of the electric wire 50 is placed on the base plate portion 43. Then, when the ram 18 is moved downward, the anvil 20 and the crimper 19 cause the core wire 52 of the electric wire 50 to be held between the pair of crimping piece portions 41, and the crimping piece portions 41 are press-deformed by the press-deforming portions 32 of the crimper 19.

The crimper 19 includes the press-deforming portion 32 of a generally arch-shape open toward the anvil 20, and is movable upward and downward. The anvil 20 is disposed below the crimper 19, and is formed into such a shape as to be fitted in the press-deforming portion 32 of the crimper 19. The upper surface of the anvil 20 serves as a crimping surface, and the curved surface 31 for the placing the metal terminal 40 thereon is formed on this crimping surface.

The metal terminal 40 is placed on the curved surface 31, with the core wire 52 received in the crimping portion of a generally U-shaped cross-section (formed by the crimping piece portions 41 and the base plate portion 43), and then the crimper 19 is moved downward to press the metal terminal 40 in the vertical direction. At this time, while distal (upper) ends of the crimping piece portions 41 gradually move upwardly in sliding contact with an inner surface of the press-deforming portion 32, the crimping piece portions 41 are pressed to be bent inwardly at their upper end portions to embrace the core wire 52, and are press-fastened to the core wire 52 in biting relation thereto.

The press-deforming portion 32 of the crimper 19 has a pair of symmetrically-disposed right and left arc-shaped surfaces, and a boundary portion between the arc-shaped surfaces projects toward the anvil. Opposed side surfaces of the press-deforming portion 32 open to the lower surface of the anvil 19 serve as guide surfaces each for guiding the corresponding crimping piece portion 41 to the arc-shaped surface.

Figure 4:
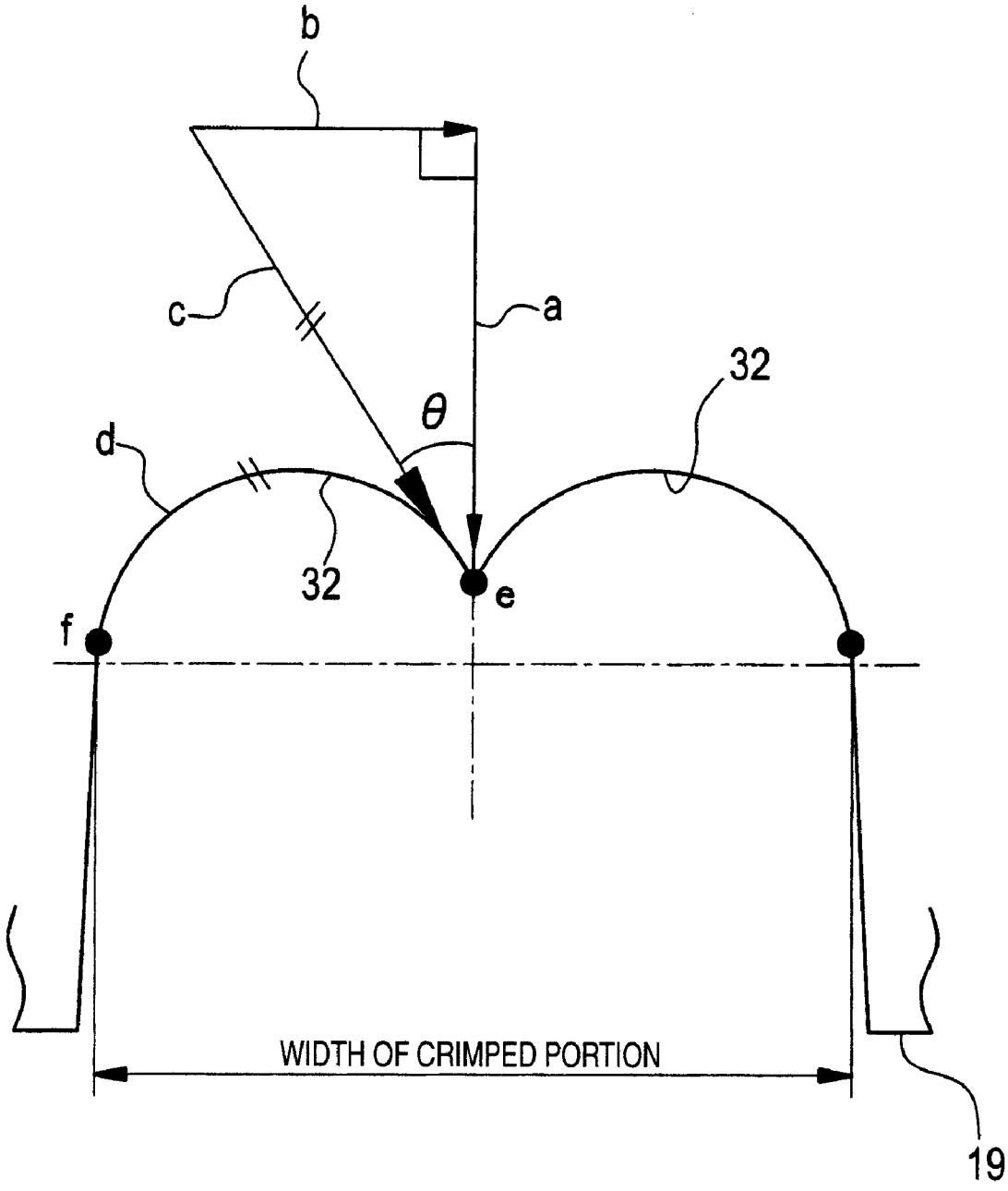
FIG. 4 is an enlarged view of an important portion of the terminal crimping apparatus of FIG. 1, showing the crimper.

As shown in FIG. 4, the press-deforming portion 32 of the crimper 19 is formed such that Index a (described later) satisfies the following formula.

$$0.7 \leqq a \leqq 0.85$$

Here, Index a is defined by a length c of the arc-shaped surface of the crimper 19 and an angle θ formed by a tangential line to the arc (arc-shaped surface) at a central portion e of the crimper 19 and a vertical line, and a formula, Index $a = c \cdot \cos\theta$, is established.

In FIG. 4, with respect to vector quantities acting on the crimping piece portion 41 (see FIG. 3) of the metal terminal 40 (see FIG. 3) by the press-deforming portion 32 of the crimper 19, reference character a represents a vector quantity acting in the vertical direction, and reference character b represents a vector quantity acting in the horizontal direction, and reference character c represents a vector quantity (the length of the arc of the crimper 19) acting in the direction tangential to the arc-shaped surface and passing the boundary portion (the central portion of the crimper 19) between the arc-shaped surfaces of the press-deforming portion 32 of the crimper 19. Reference character d represents the length of the arc-shaped surface, and is equal to the vector quantity c. The angle θ represents the angle formed by the directions of the vectors a and c (the angle formed by the tangential line to the arc at the central portion e of the crimper 19 and the vertical line).

FIGS. 5A to 5D are schematic cross-sectional views showing the process of crimping the crimping piece portions 41 of the metal terminal 40 to the core wire 52 (see FIG. 3) of the electric wire 50 (see FIG. 3).

Figures 5A, 5B, 5C, 5D:
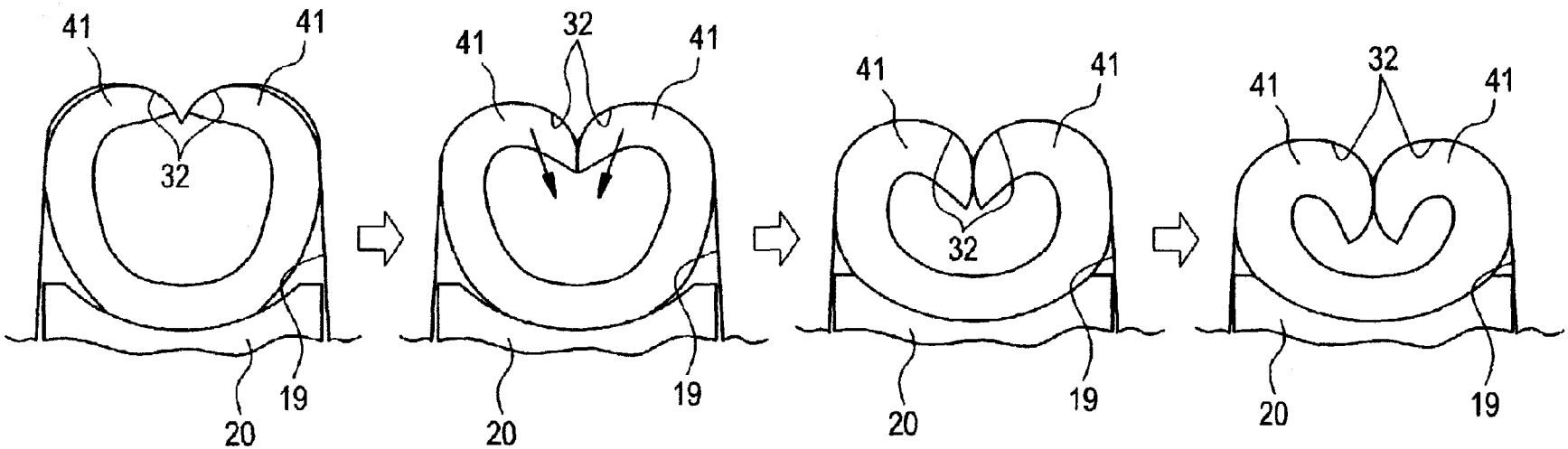
FIGS. 5A to 5D are schematic cross-sectional views showing the process of crimping a metal terminal to the electric wire.

Namely, the crimping piece portions 41 of the metal terminal 40 begin to be bent by the crimper 19 and the anvil 20 as shown in FIG. 5A, and then the crimping piece portions 41 are further bent, so that their distal ends are directed downwardly as shown in FIG. 5B. Then, the crimping piece portions 41 are further bent, so that their distal ends are brought into abutting engagement with each other as shown in FIG. 5C, and then the crimping piece portions 41 are further bent, so that their distal ends bite into the core wire 52 (see FIG. 3), and therefore the crimping piece portions 41 are press-fastened to the core wire 52.

Index a=c·cos θ which is defined by the length c of the arc of the crimper 19 and the angle θ formed by the tangential line to the arc at the central portion e of the crimper 19 and the vertical line is set to the range, 0.7≦a≦0.85. With this arrangement, in the process step shown in FIG. 5B, the pressing force is exerted in such a direction that the distal ends of the crimping piece portions 41 can be more easily directed downward. And besides, in the process step shown in FIG. 5D, the right and left crimping piece portions 41 bite uniformly into the electric wire 50 (see FIG. 3). As a result, the wire crimped portion is formed into predetermined height and width, and therefore has the stable shape.

Particularly in the case of using a very thin electric wire whose core wire 52 has a cross-sectional area of 0.08 to 0.13 mm and made of a material (such as a copper alloy) harder than that used in conventional electric wires, there can be obtained the wire crimped portion which is made stable in shape and also has the stable performances (that is, is not lowered in mechanical and electrical performances).

Figures 6A, 6B, 6C:
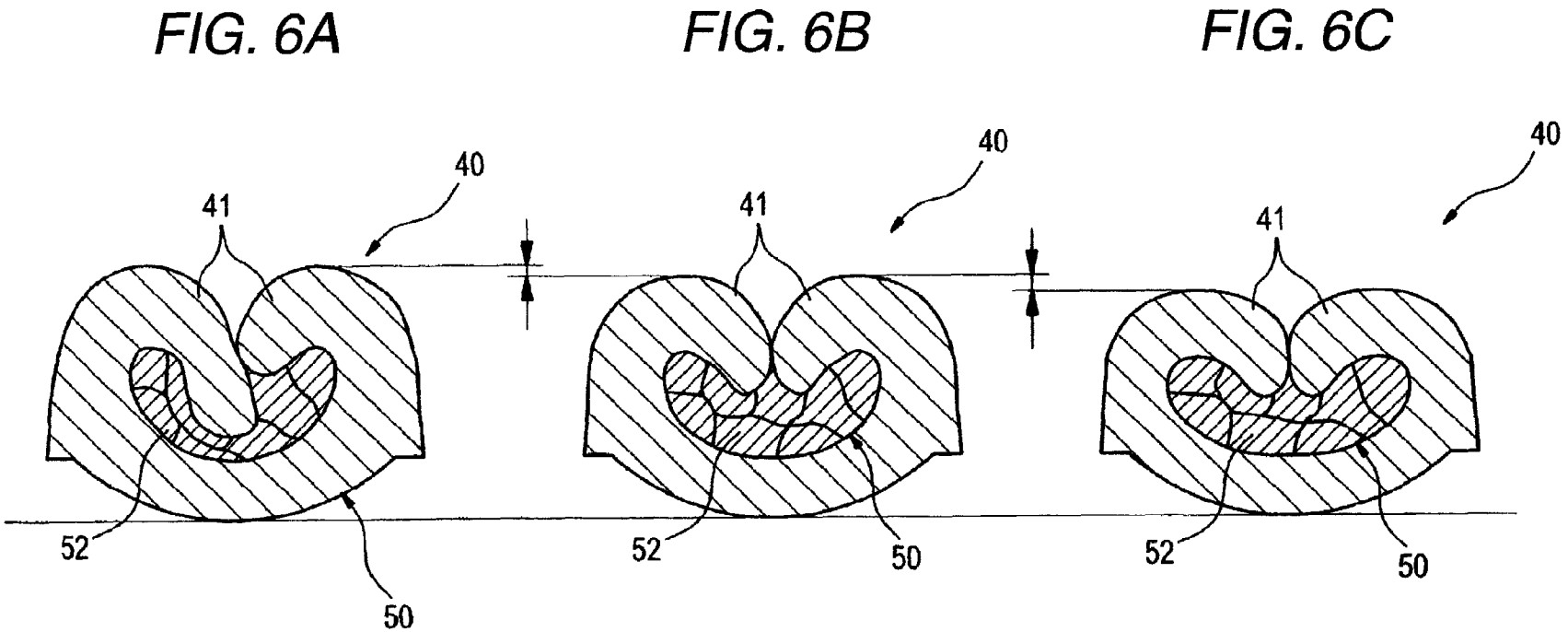
FIGS. 6A to 6C are schematic cross-sectional views of wire crimped portions formed respectively by crimpers of different shapes.
Figure 7:
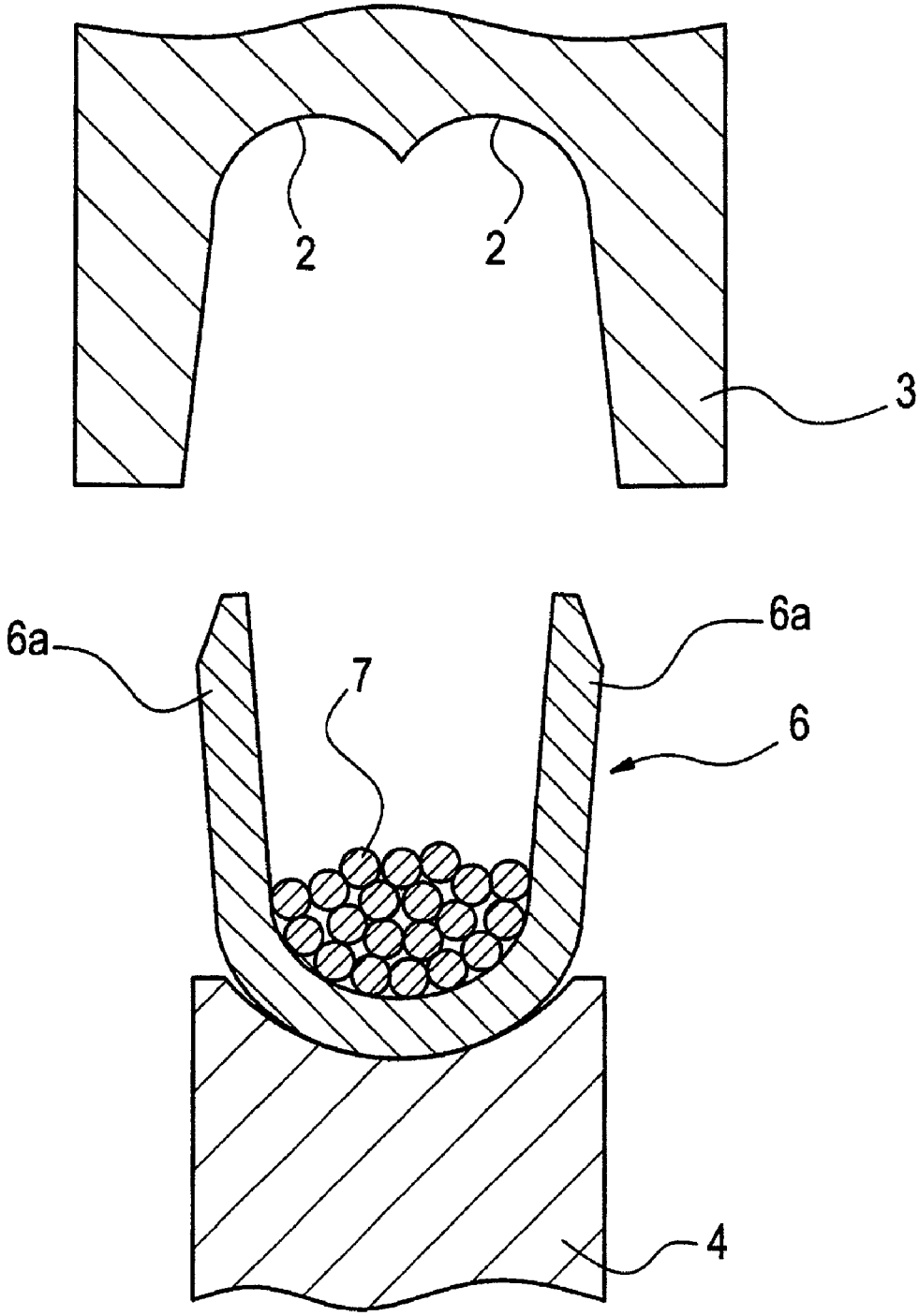
FIG. 7 PRIOR ART
FIG. 7 is a schematic cross-sectional view showing a terminal crimping die disclosed in JP-A-2002-373755.

FIGS. 6A to 6C are schematic cross-sectional views of wire crimped portions formed respectively by crimpers of different shapes. Namely, these Figures show results obtained when metal terminals 40 were crimped to respective electric wires 50, using respective crimpers (Example 1 and Comparative Examples 1 and 2) gradually changed in Index a=c·cos θ. A core wire 52 used here for each electric wire was made of a copper alloy containing tin (Sn) (The Sn content: 0.3%), and the cross-sectional area of the core wire was 0.13 $mm^2$. Incidentally, similar results were obtained also with electric wires each having a core wire whose cross-sectional area was 0.08 $mm^2$.

FIG. 6A shows the cross-section of the wire crimped portion crimped by the crimper (Comparative Example 1) of (a<0.7).

As will be appreciated from FIG. 6A, with the use of the crimper of (a<0.7), right and left crimping piece portions 41 did not bite uniformly into the core wire 52, and the crimping piece portions 41 were press-deformed in such a manner that one of them overlaps the other. A height of the wire crimped portion was higher than a predetermined height, and an area of contact of the crimping piece portions 41 of the metal terminal 40 with the core wire 52 was smaller than a predetermined value. Furthermore, the biting of the crimping piece portions 41 into the core wire 52 was insufficient, and therefore the wire clamping force was lowered.

FIG. 6B shows the cross-section of the wire crimped portion crimped by the crimper (Example 1) of (0.7≦a≦0.85).

As will be appreciated from FIG. 6B, with the use of the crimper of (0.7≦a≦0.85), the wire crimped portion was formed into the predetermined height and width.

FIG. 6C shows the cross-section of the wire crimped portion crimped by the crimper (Comparative Example 2) of (a>0.85).

As will be appreciated from FIG. 6C, with the use of the crimper of (a>0.85), a height of the wire crimped portion was smaller than the predetermined height, and a mechanical strength of the wire crimped portion was lowered.

The results of FIGS. 6A to 6C as well as results of very thin electric wires with a cross-sectional area of 0.08 $mm^2$ are shown in Table 1.

TABLE 1

| Sample | Cross-sectional area of core wire | Index A | Mechanical strength | Electrical characteristics | Overall evaluation |
|---|---|---|---|---|---|
| comparative example 1 | 0.13 $mm^2$ | a < 0.7 | ○ | X | X |
| example 1 | | 0.7 ≦ a ≦ 0.85 | ○ | ○ | ○ |
| comparative example 2 | | a > 0.85 | X | ○ | X |
| comparative example 3 | 0.08 $mm^2$ | a < 0.7 | ○ | X | X |
| example 2 | | 0.7 ≦ a ≦ 0.85 | ○ | ○ | ○ |
| comparative example 4 | | a > 0.85 | X | ○ | X |

○ indicates within predetermined range
X indicates outside predetermined range and improper It will be appreciated from FIGS. 6A to 6C and the results of Table 1 that with the use of the crimper (Example 1) having the press-deforming portion of a generally arch-shape in which Index a=c·cos θ which is defined by the length c of the arc of the crimper and the angle θ formed by the tangential line to the arc at the central portion e of the crimper and the vertical line is in the range of from 0.7 to 0.85 (0.7≦a≦0.85), the wire crimped portion is formed into the predetermined height and width. Therefore, there can be obtained the wire crimped portion which made stable in shape, and is not lowered in mechanical strength and electrical characteristics.

On the other hand, when the crimper (Comparative Example 1) having the press-deforming portion of a generally arch-shape in which Index a is less than 0.7 (a<0.7), the amount of biting of the crimping piece portions 41 of the metal terminal 50 into the core wire 52 is insufficient, and the area of contact of the crimping piece portions 41 of the metal terminal 40 with the core wire 52 is reduced, so that the contacting reliability is lowered.

When the crimper (Comparative Example 2) having the press-deforming portion of a generally arch-shape in which Index a is more than 0.85 (a>0.85), the amount of biting of the crimping piece portions 41 of the metal terminal 40 into the core wire 52 is excessive, so that the core wire 52 is much damaged, and the force (strength) of clamping of the metal terminal 40 to the core wire 52 is lowered. And besides, it is difficult to process the crimper.

As described above, in the terminal crimping apparatus 10 of the above embodiment, the shape of the wire crimping portion can be made stable, and in the condition in which the crimping piece portions 41 of the metal terminal 40 are crimped to the core wire 52, the contact area as well as the contacting load can be made stable.

Namely, the reduced contact area due to the increased crimp height caused by the overlapping of one crimping piece portion 41 of the metal terminal 40 on the other crimping piece portion 41, the reduced strength of the core wire 52 due to the reduced crimp height caused by the bottoming of one crimping piece portion 41, etc., can be prevented.

Therefore, the uniform and proper biting of the crimping piece portions 41 of the metal terminal 40 into the core wire 52 can be easily achieved, and the stable crimped condition of each crimping piece portion 41 relative to the core wire 52 can be obtained. Therefore, without actually preparing sample crimpers, the desired crimper can be designed while accurately predicting the crimping performance, and the mechanical and electrical performances can be enhanced, and the time, labor and costs required for the design and evaluation can be reduced.

The present invention is not limited to the above embodiment, and various modifications, improvements, etc., can be suitably made. Furthermore, the material, dimensions, numerical value, form, number, disposition, etc., of each of the constituent elements of the above embodiment are arbitrary, and are not limited in so far as the invention can be achieved.

The present application is based on Japan Patent Application No. 2007-009135 filed on Jan. 18, 2007, the contents of which are incorporated herein for reference.

What is claimed is:

1. A terminal crimping apparatus comprising:

an anvil for supporting a metal terminal including a base plate portion for placing an electric wire thereon and a pair of crimping piece portions extending upwardly respectively from opposite side edges of the base plate portion; and a crimper which includes a press-deforming portion having a generally arch-shape formed of two arc-shaped surfaces which are opposed to the anvil, wherein the anvil and the crimper cooperate to press the crimping piece portions for crimping the crimping piece portions to the electric wire placed on the metal terminal; and wherein the shape of the crimper satisfies a formula, Index $a=c\cdot\cos\theta$, where c represents a length of the arc-shaped surface of the crimper, and $\theta$ represents an angle formed by a tangential line to the arc-shaped surface at a central portion of the crimper and a vertical line, the Index $a=c\cdot\cos\theta$ is within the range of from 0.7 to 0.85 ($0.7\leqq a\leqq 0.85$), the metal terminal is crimped to the electric wire having a cross-sectional area of 0.08 to 0.13 $mm^2$, the metal terminal is crimped to the electric wire made of a copper alloy, the quantity Index a equals a vector quantity acting in a downward vertical direction on the crimping piece portions, c represents a vector quantity acting in a direction tangential to the arc-shaped surface of the crimper and toward the central portion of the crimper; and a vector quantity b represents a vector quantity acting in a horizontal direction such that the vector quantity b plus the vector quantity a equals the vector quantity c(b+a=c), vector quantity b having a value greater than zero.

* * * * *